US005214847A

United States Patent [19]

Aoki

[11] Patent Number: 5,214,847

[45] Date of Patent: Jun. 1, 1993

[54] METHOD FOR MANUFACTURING A HEAT EXCHANGER

[75] Inventor: Hisao Aoki, Maebashi, Japan

[73] Assignee: Sanden Corporation, Gunma, Japan

[21] Appl. No.: 807,740

[22] Filed: Dec. 16, 1991

Related U.S. Application Data

[63] Continuation of Ser. No. 665,890, Mar. 7, 1991, abandoned.

[30] Foreign Application Priority Data

Mar. 7, 1990 [JP] Japan ..... 2-56199
Mar. 7, 1990 [JP] Japan ..... 2-56200

[51] Int. Cl.[5] ..... B21D 53/02

[52] U.S. Cl. ..... 29/890.043; 29/890.052

[58] Field of Search ..... 29/890.043, 890.046, 29/890.052, 890.053, 428; 165/110, 153

[56] References Cited

U.S. PATENT DOCUMENTS 1,583,758 5/1926 White .
1,729,180 9/1929 Murray ..... 29/890.052
2,262,627 11/1941 Whitesell ..... 29/890.052
3,246,691 4/1966 Porte et al. ..... 29/890.043
3,866,675 2/1975 Bardon et al. .
4,382,468 5/1983 Hastwell ..... 29/890.043
4,620,590 11/1986 Koisuka et al. .
4,945,635 8/1990 Nobusue et al. ..... 29/890.053
4,969,512 11/1990 Hisao et al. .

FOREIGN PATENT DOCUMENTS 243476 2/1960 Australia .
0167039 10/1983 Japan ..... 29/890.052
0188234 7/1989 Japan ..... 29/890.052
944094 12/1963 United Kingdom .

*Primary Examiner*—Irene Cuda
*Attorney, Agent, or Firm*—Baker & Botts

[57] ABSTRACT

A method of manufacturing a heat exchanger includes a pair of tubular header pipes having a plurality of connection holes for heat exchanger tubes extended between the header pipes. A plurality of opposite corresponding cut portions are formed on both ends of a plate. The plate is bent into an almost tubular shape. The heat exchanger tubes are inserted into the opposite cut portions. The plate is further bent into a complete tubular shape, with the opposite cut portions forming completed connection holes. Thus, the connection holes are formed at desired positions of the heat exchanger and simultaneously, the tubes can be precisely and securely connected to the header pipes.

28 Claims, 11 Drawing Sheets

METHOD FOR MANUFACTURING A HEAT EXCHANGER

This application is a continuation, of application Ser. No. 07/665,890, filed Mar. 7, 1991, now abandoned.

BACKGROUND OF THE INVENTION

1. Field of the Invention

The present invention relates to a heat exchanger for use as an evaporator or a condenser for an air conditioner circuit, a radiator or a heater core for a vehicle, or other type heat exchanger. The invention further relates to methods for manufacturing header pipes of a heat exchanger and for connecting the header pipes and tubes in the heat exchanger.

2. Description of the Prior Art

FIGS. 1 and 2 show a typical conventional heat exchanger which allows heat to be exchanged between a heat exchange medium (for example, a cooling medium or a brine) flowing in the heat exchanger and air passing through the heat exchanger. Heat exchanger 21, as shown in FIG. 1, includes a pair of header pipes 22 extending in parallel relation to each other, a plurality of tubes 23 disposed between the header pipes and connected to the header pipes at their opposite open end portions, and with a predetermined pitch in the vertical direction, a plurality of radiation fins 24 provided on the sides of the tubes, and a pair of reinforcement members 25 disposed on the top and bottom radiation fins.

Each header pipe 22 is constructed from a welded aluminum pipe. A plurality of connection holes 26 are formed through the periphery of header pipes 22 with a predetermined pitch in the axial direction of the header pipe. The end portion of each tube 23 is inserted into a corresponding connection hole 26 so that the inside of the tube is in fluid communication with the inside of the header pipe 22. Both ends of each header pipe 22 are closed by caps 27. An inlet tube (not shown) for introducing the heat exchange medium into heat exchanger 21 is connected to one of the header pipes 22, and an outlet tube (not shown) for delivering the heat exchange medium out from heat exchanger 21 is connected to the other header pipe.

Each tube 23 is formed as a straight tube which is flattened in the horizontal direction. The end portions of tubes 23 are inserted in connection holes 26 of header pipes 22, and fixed therein by, for example, brazing. Corrugated type radiation fins 24 are fixed on the upper and lower surfaces of each tube 23 by, for example, brazing.

The heat exchanger is manufactured, for example, in the following manner.

Welded pipes, formed as header pipes 22, are prepared. A plurality of connection holes 26, each having substantially the same shape as the peripheral shape of tubes 23, are formed on each welded pipe with a predetermined pitch in the axial direction of the welded pipe. Tubes 23 and radiation fins 24 are then arranged in alternating order with the pitch of the tubes equal to the pitch of holes 26. Both end portions of the arranged tubes 23 are inserted into corresponding connection holes 26 of header pipes 22. Once the components are positioned, the portions to be connected are secured together by, for example, brazing.

The connection holes 26 in such a conventional heat exchanger are formed into the periphery of the welded pipe, formed as header pipe 22, after the welded pipe is made. This practice, due to the shape of the welded pipe, requires the use of a special jig or tool for forming the holes. This operation causes the manufacturing of the header pipe to be expensive. Consequently, it is difficult to produce heat exchangers inexpensively. In addition, since it is generally difficult to form connection holes 26 precisely at predetermined positions on the periphery of a welded pipe having a circular cross section, defects are liable to occur while inserting and connecting tubes 23 into the header pipes 22. For example, since the end portions of tubes 23 are merely inserted into corresponding holes 26 of header pipes 22, tubes 23 may be removed from holes 26 by vibration or impact when the arranged heat exchanger is moved before brazing. Furthermore, the welded pipe is made merely by bending a flat plate in the form of a pipe and welding the side edges of the bent plate to each other. In this construction, the welded portion generally does not have a high strength, particularly against pressure. Therefore, cracks due to a high pressure fluid passing through the header pipes are liable to occur on the welded portion during use of the heat exchanger over a long period of time.

SUMMARY OF THE INVENTION

The present invention is directed to a method of manufacturing a heat exchanger including a pair of header pipes having a plurality of connection holes. A plurality of tubes extend between the header pipes and have opposite open ends disposed through the connection holes. A plurality of cut portions are formed on both longitudinal sides of a plate, each cut portion on one side corresponding to a cut portion on the other side. The plates are bent into nearly completed header pipes such that the opposite longitudinal sides are near each other. The tubes are inserted between the nearly completed header pipes with the opposite open ends of the tubes disposed in a pair of corresponding cut portions. The nearly completed header pipes are further bent into complete header pipes such that the cut portions form the connection holes. Thereafter, the finished exchanger may be brazed.

One advantage of the present invention is that the connection holes can be formed easily at the desired positions, with the tubes precisely and securely connected to the header pipes before brazing.

Another advantage of the present invention is that jigs are not required to manufacture the heat exchanger. In addition, an exchanger manufactured according to the present invention includes header pipes which maintain a high degree of rigidity and strength over a long period of time.

BRIEF DESCRIPTION OF THE DRAWINGS

FIG. 17(*b*) is a perspective view showing a connection between a tube and a header pipe assembled as shown in FIGS. 16(*a*)-(*c*).

DETAILED DESCRIPTION OF THE PREFERRED EMBODIMENTS

Figure 1:
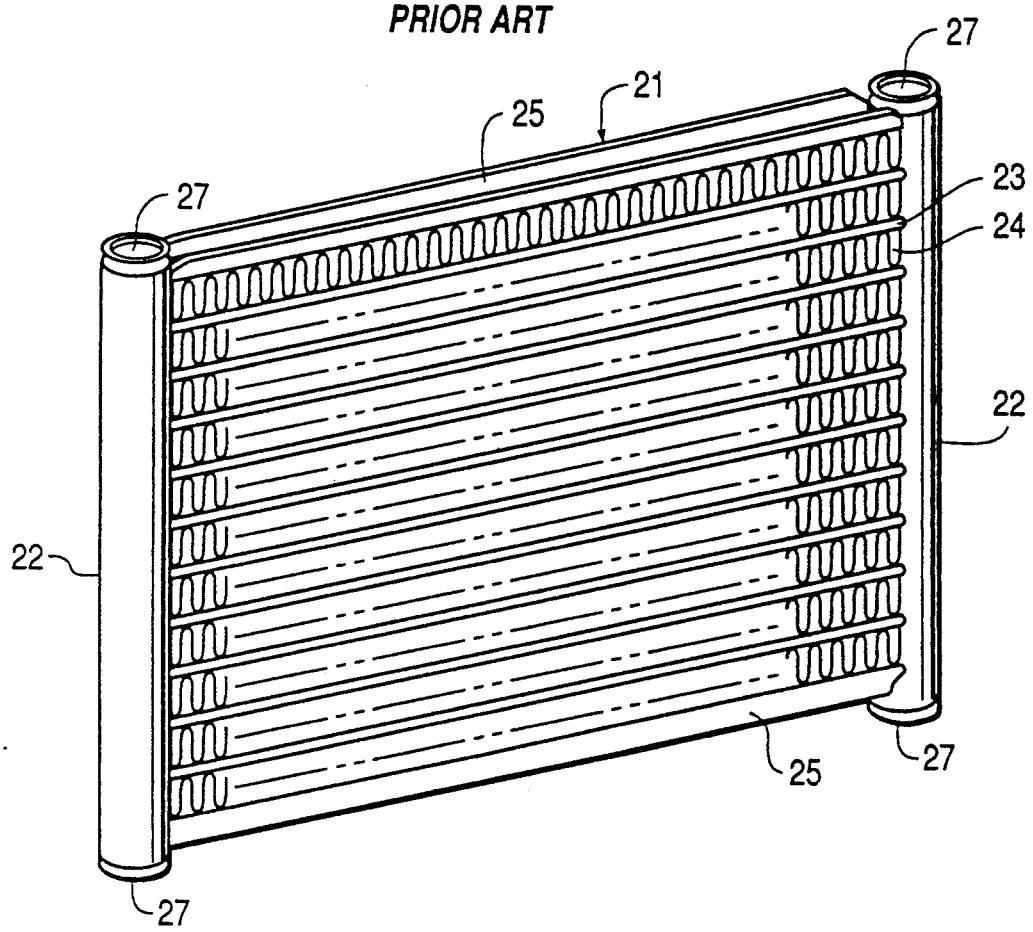
FIG. 1 PRIOR ART
FIG. 1 is a perspective view of a conventional heat exchanger.
Figure 2:
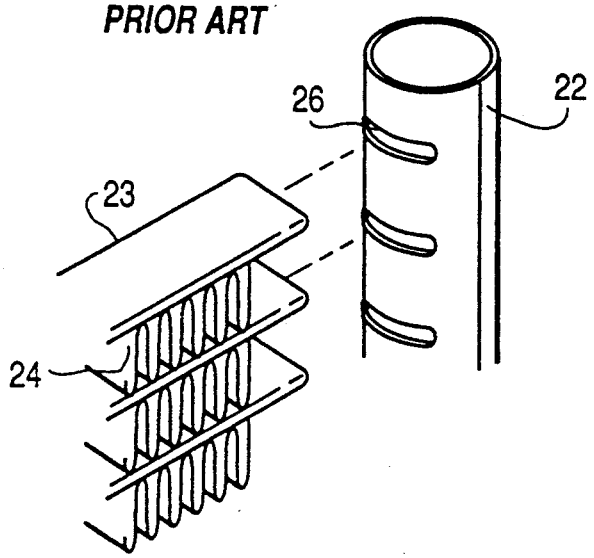
FIG. 2 PRIOR ART
FIG. 2 is an exploded perspective view showing the connection between a header pipe and tubes as shown in FIG. 1.
Figure 3:
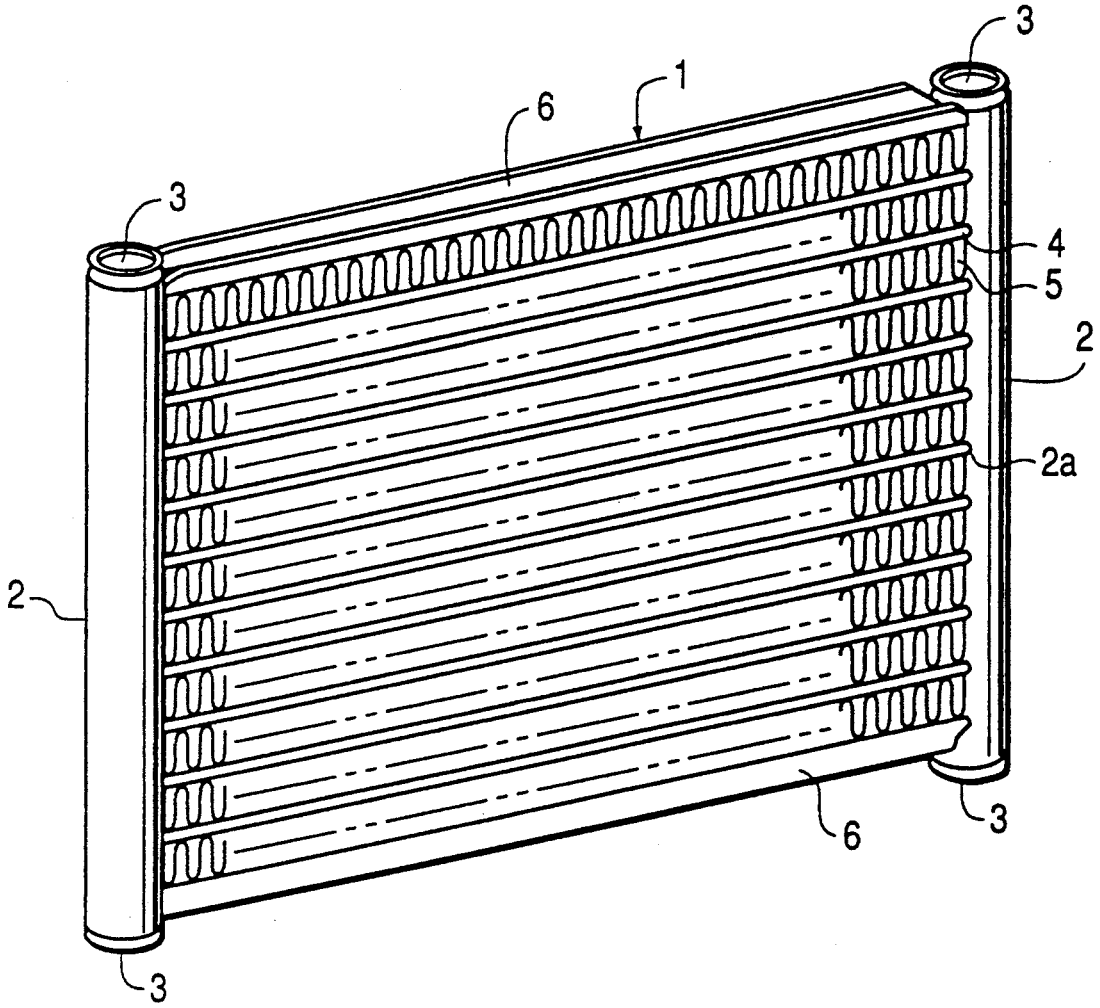
FIG. 3 is a perspective view of a heat exchanger made in accordance with one embodiment of the present invention.
Figure 4:
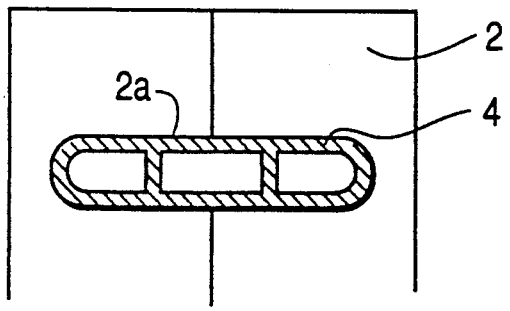
FIG. 4 is a cross-sectional view of a tube connected to a header pipe as shown in FIG. 3.

Referring to the drawings, FIGS. 3-5 illustrate a heat exchanger according to a first embodiment of the present invention. In FIG. 3, heat exchanger 1 has a pair of header pipes 2 extending in parallel relation to each other. Header pipes 2 are closed at both of their end portions by caps 3. A plurality of substantially parallel tubes 4 are disposed between the pair of header pipes 2 with a predetermined pitch in the vertical direction. Tubes 4 are formed as flat tubs in this embodiment. Flat tubes 4 are connected to the pair of header pipes 2 at their opposite open end portions. A plurality of corrugate type radiation fins 5 are provided on the sides of tubes 4 and are fixed to the tubes by, for example, brazing. Reinforcement members 6 are provided on the upper surface of the top radiation fin 5 and the lower surface of the bottom radiation fin 5, respectively. Reinforcement members 6 are fixed to the upper and lower surfaces of the respective radiation fins and the sides of header pipes 2. A heat exchange medium (for example, a cooling medium or a brine) is introduced through a conventional inlet tube (not shown) connected to one of the header pipes 2, flows through header pipe 2 and tubes 4, exchanging heat with a fluid flowing over tubes 4 and through fins 5, into the other header pipe, and out of a conventional outlet tube (not shown) connected to the other header pipe. For example, a conventional inlet union joint could be connected to the top of the inlet header and to the bottom of the outlet header in place of caps 3, as shown in U.S. Pat. No. 4,825,941 to Hoshino et al, hereby incorporated by reference.

Each header pipe 2 has a plurality of connection holes 2*a* arranged with a predetermined pitch in the longitudinal direction of the header pipe. The opposite open end portions of tubes 4 are inserted into connection holes 2*a* and fixed to header pipes 2 by brazing. Each header pipe 2 is constructed from a pipe member which is formed by bending a longitudinal aluminum flat plate clad with a brazing material in the form of a pipe, to achieve the configuration shown in FIG. 4.

Figure 5A:
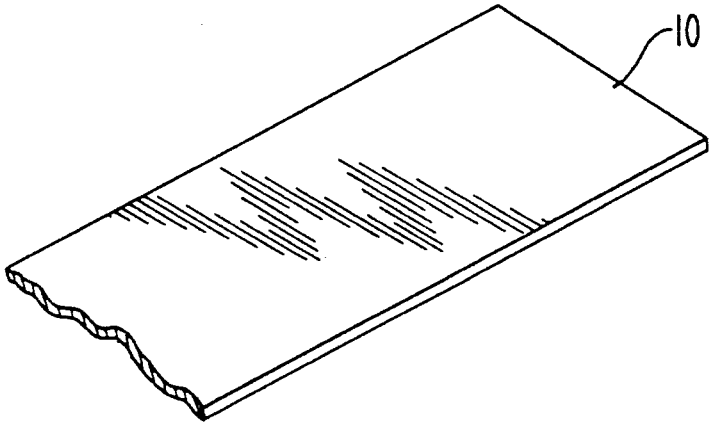
FIGS. 5(*a*)–(*c*) are perspective views showing a sequence of steps performed on a planar plate in accordance with a first embodiment of the present invention.
Figure 5B:
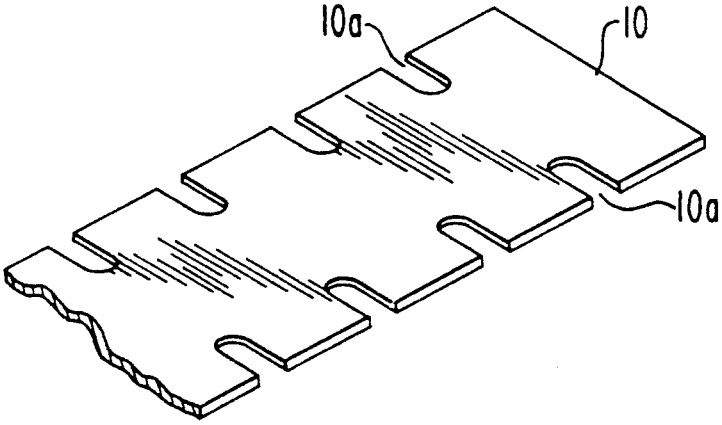
Figure 5C:
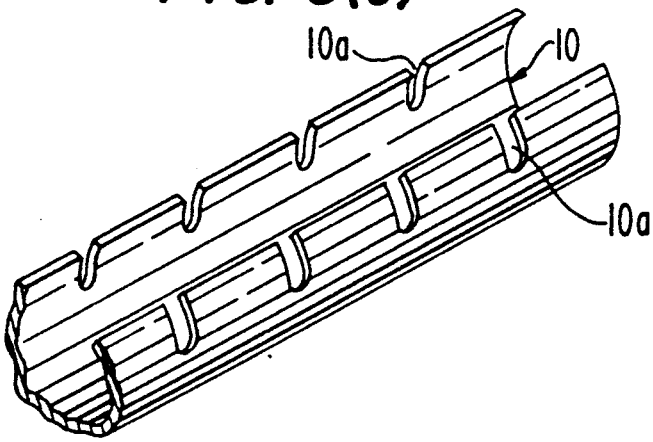

Header pipes 2 are manufactured in the manner shown in FIGS. 5*a*-5*c*. As shown in FIG. 5*a*, longitudinal flat plate 10 clad with a brazing material on one or both of the planar surfaces of the plate is prepared in a conventional manner. As shown in FIG. 5*b*, a plurality of cut portions 10*a* are formed on both longitudinal sides of flat plate 10. Each portion 10*a* is aligned opposite another portion 10*a*, and portions 10*a* are defined with a predetermined pitch in the longitudinal direction of the plate. The depth of cut portions 10*a* is selected to be substantially half the width of each tube 4, as shown in FIG. 4.

Subsequently, longitudinal flat plate 10 is bent in the form of a pipe, as shown in FIG. 5*c*. This bending is performed, for example, by using a core rod and winding and pressing longitudinal flat plate 10 onto the core rod. After this initial bending, the longitudinal sides of flat plate 10 are disposed near each other but are not yet in contact.

Figure 6A:
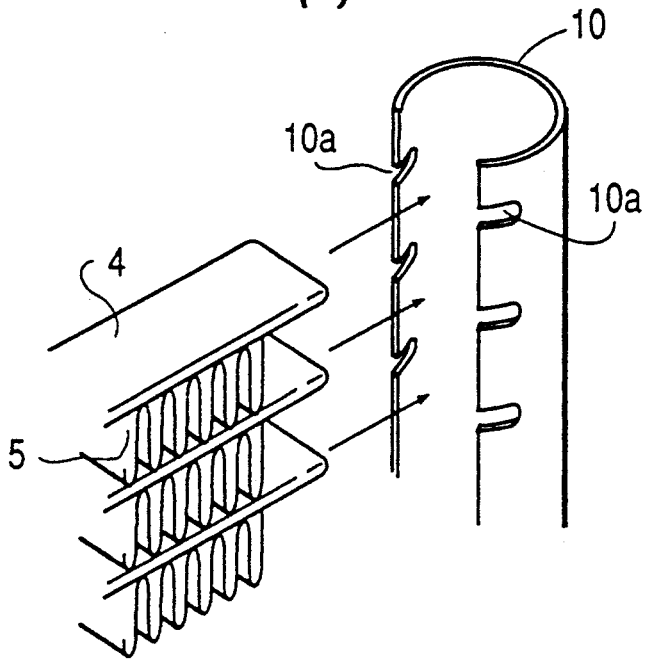
FIGS. 6(*a*)-(*b*) and 7 are perspective views showing the steps of assembling a heat exchanger in accordance with a first embodiment of the present invention.
Figure 6B:
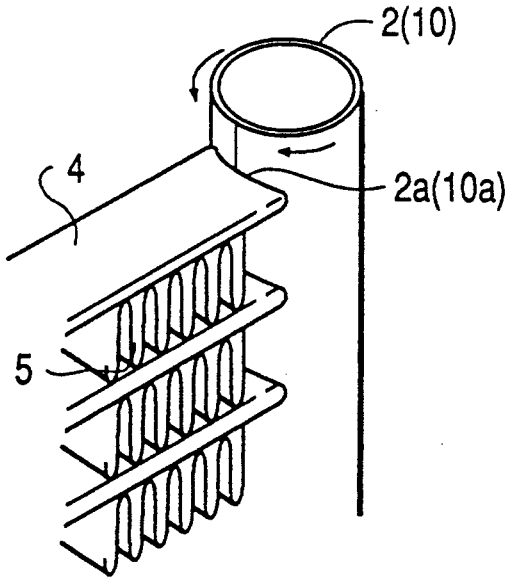

In the manufacture of heat exchanger 1, tubes 4 and radiation fins 5 are stacked in alternating order, and inserted between a pair of header pipes 2 having the open configuration shown in FIG. 5*c*, as shown in FIG. 6(*a*). As shown by the arrows in FIG. 6(*a*), the end portions of tubes 4 are inserted into the not yet fully formed connection holes 2*a* of open pipes 10, with opposing cut portions 10*a* at both longitudinal sides of flat plate 10 retaining each corresponding tube 4. As shown by the arrows in FIG. 6*b*, pipes 10 are further bent around the end portions of tubes 4 so that pipes 10 assume a finished circular shape, with the inner surface of portions 10*a*, which now form finished connection holes 2*a*, in contact with the outer surface of tubes 4. Thereafter, caps 3 and reinforcement members 6 are assembled to the pair of header pipes 2. The assembled exchanger is placed in a furnace such that all of the parts are simultaneously brazed.

Figure 7:
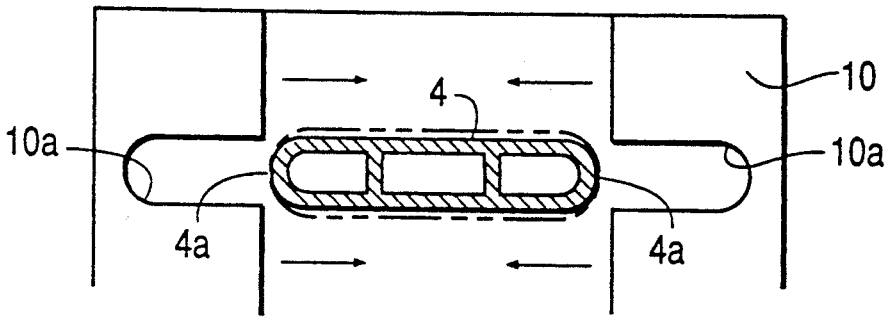

In the manufacture of heat exchanger 1, since cut portions 10*a* retain each tube 4 during the process of bending longitudinal flat plate 10 into the form of a pipe, even if the position of one or more tube 4 does not precisely correspond to that of cut portions 10*a*, as shown by the two-dotted line in FIG. 7, the position of tube 4 is corrected so as to correspond to that of cut portions 10*a*. That is, side surfaces 4*a* of tubes 4 are guided into cut portions 10*a* as pipes 10 are bent into the final circular shape. Thus, if one of tubes 4 is above or below the level of the corresponding cut portions 10*a*, it will still be forced into a finished connection hole 2*a* and securely retained during brazing.

Figure 8:
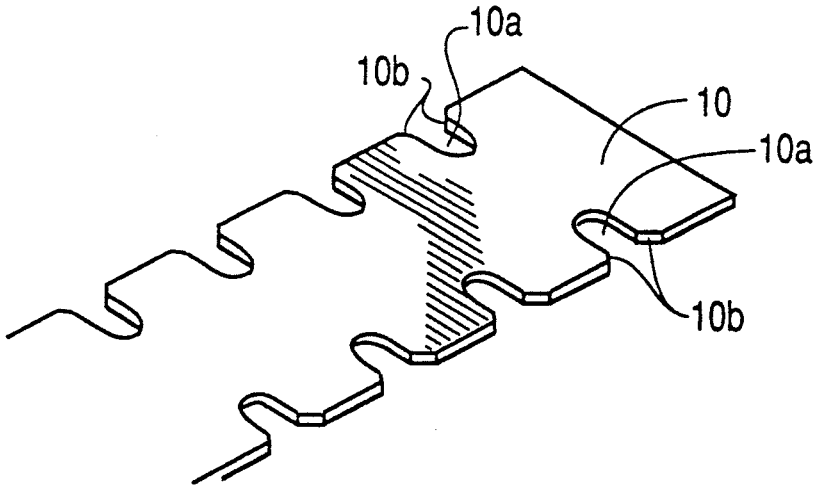
FIG. 8 is a perspective view of a planar plate formed in accordance with a second embodiment of the present invention.
Figure 9:
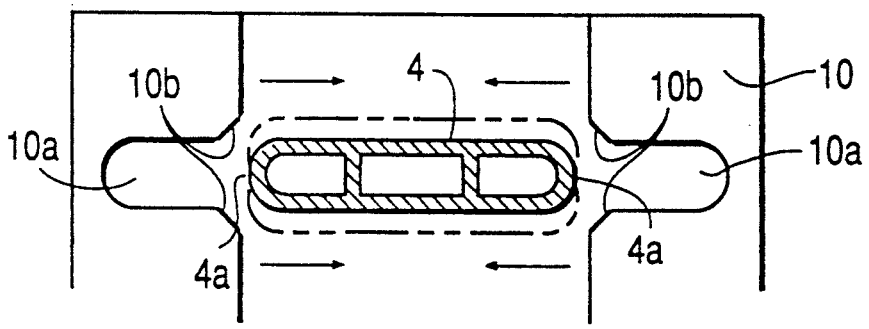
FIG. 9 is an explanatory view showing the assembly of a tube to a header pipe in accordance with the second embodiment of the present invention.

With reference to FIG. 8, a heat exchanger according to a second embodiment of the present invention is shown. In order to enlarge the possible scope of the correction of the position of tube 4 during assembly, guide surfaces 10*b* are formed on the open peripheral surface of cut portions 10*a*. That is, surfaces 10*b* extend from cut portions 10*a* to the longitudinal side surfaces of flat plate 10. Even though the discrepancy of the position between them is larger, the position of tubes 4 can be more easily corrected during assembly by surfaces 10*b* and 4*a* as shown in FIG. 9, since the size of the openings of cut portions 10*a* is substantially enlarged.

Figure 10:
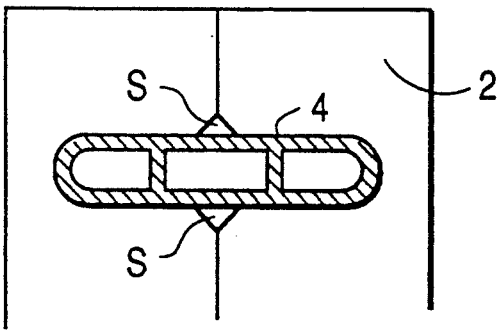
FIG. 10 is a cross-sectional view of a tube connected to a header pipe assembled as shown in FIG. 9.
Figure 11:
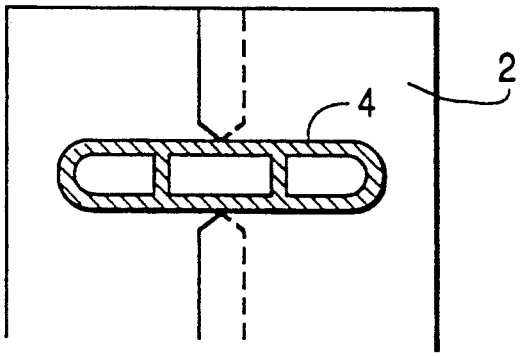
FIG. 11 is a cross-sectional view of a tube connected to a header pipe assembled in accordance with a third embodiment of the present invention.
Figure 12:
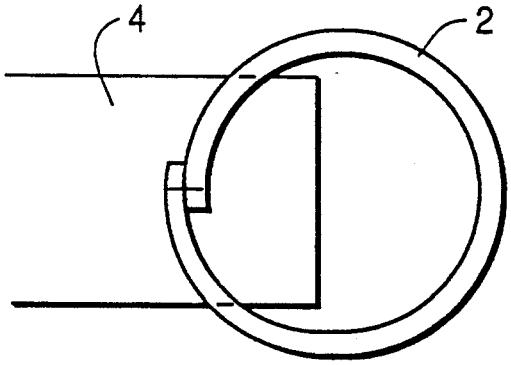
FIG. 12 is a plane view showing a connection between a tube and a header pipe as shown in FIG. 11.

Although gaps S are defined by guide surfaces 10*b* as shown in FIG. 10 after tubes 4 and header pipes 2 are assembled, if the gaps S are small, they will be filled in or closed by brazing material during brazing. On the other hand, if the gaps S are large, the gaps S may not be completely closed by brazing material and the strength of header pipe 2 or tubes 4 may be reduced. Accordingly, to avoid this problem, the longitudinal sides of flat plate 10 may be overlapped during the bending process to eliminate gaps S, as shown in FIGS. 11 and 12.

Figure 13:
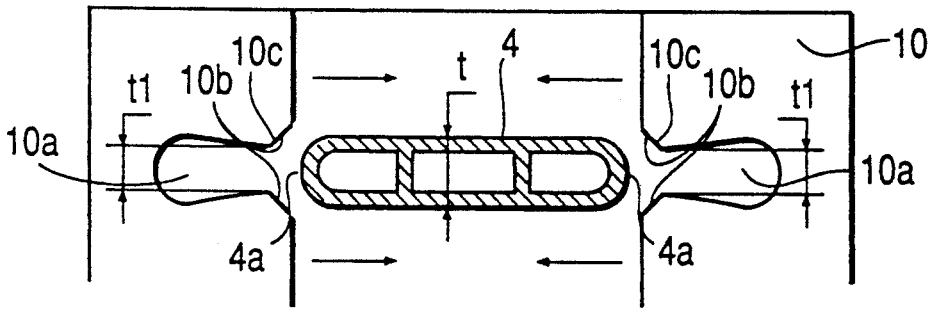
FIG. 13 is an explanatory view showing the assembly of a tube to a header pipe in accordance with a fourth embodiment of the present invention.

Furthermore, with reference to FIG. 13, the construction of tubes 4 and header pipes 10 according to a fourth embodiment of the present invention is shown. Cut portions 10*a* are formed to taper inwardly from the inner end towards inner end portions 10*c* of guide surfaces 10*b*. The width $t_1$ of cut portion 10*a* at portions 10*c* is less than the outer thickness t of tubes 4. During assembly, tubes 4 are securely held in cut portions 10*a* due to the smaller width at portions 10*c*.

Figure 14:
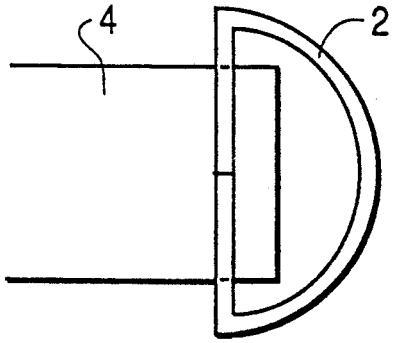
FIGS. 14 and 15 are plane views showing the connection between a tube and a header pipe as shown in FIG. 13.
Figure 15:
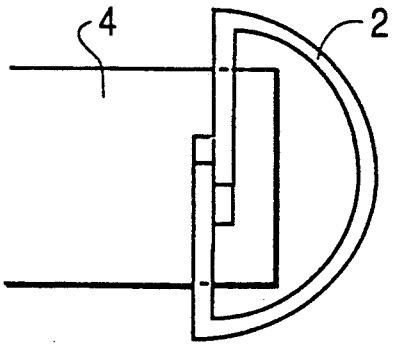

In addition, the cross-sectional shape of header pipe 2 is not limited to being circular. The shape may be semicircular as shown in FIGS. 14 and 15, rectangular, oval or any other desired shape.

Figure 16A:
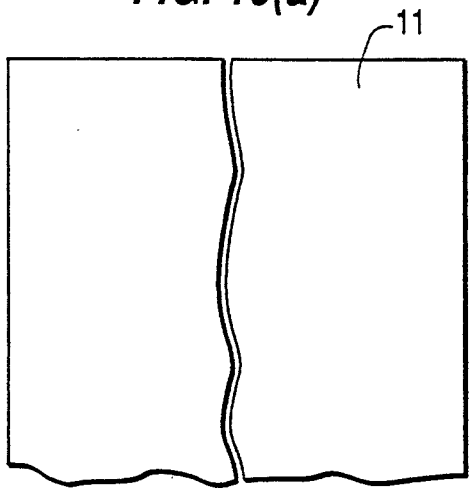
FIGS. 16(*a*)-(*c*) are perspective views showing a sequence of steps performed in accordance with a fifth embodiment of the present invention.
Figure 16B:
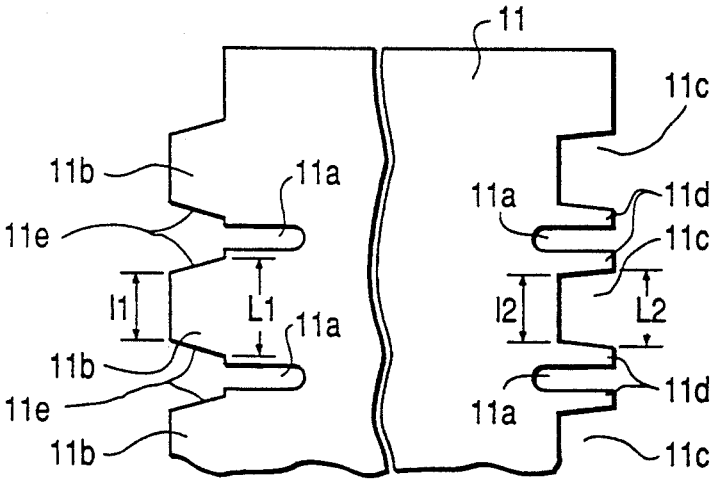
Figure 16C:
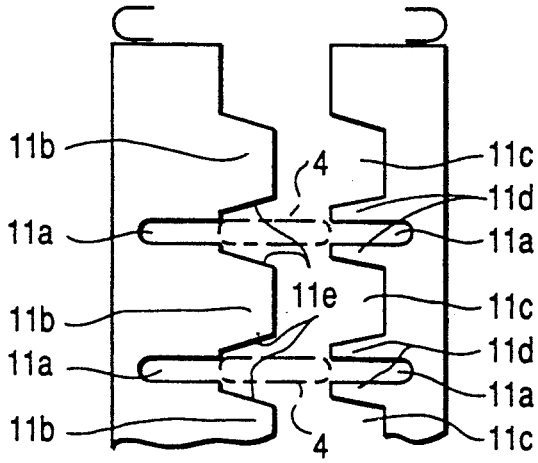

With reference to FIGS. 16(*a*), (*b*) and (*c*), the process of manufacturing a header pipe of a heat exchanger according to a fifth embodiment of the present invention is shown.

Longitudinal flat plate 11 clad with a brazing material on one or both of the surfaces of the plate is prepared, as shown in FIG. 16(*a*). As shown in FIG. 16(*b*), a plurality of cut portions 11*a* are formed on both longitudinal sides of flat plate 11, each of which is aligned to be opposite another cut portion 11*a*. Portions 11*a* are defined with a predetermined pitch in the longitudinal direction. The depth of cut portions 11*a* is half of the width of each tube 4. A plurality of outwardly projecting trapezoidal guides 11*b* are formed on one longitudinal side of flat plate 11. Guides 11*b* are formed adjacent to cut portions 11*a*, and alternate with portions 11*a* in the longitudinal direction. A corresponding plurality of inwardly projecting trapezoidal guides 11*c* are formed on the other longitudinal side of flat plate 11. The formation of inward guides 11*c* results in the formation of flexible portions 11*d* projecting from the longitudinal side surface of plate 11 and adjacent to cut portions 11*a*, on either side thereof in the longitudinal direction. Guides 11*b* and 11*c* may be formed by cutting the longitudinal sides of flat plate 11 before bending.

Trapezoidal guides 11*c* are formed to be opposite to trapezoidal guides 11*b*, with flexible portions 11*d* positioned to be disposed within spaces defined by side surfaces 11*e* of trapezoidal guides 11*b*, when pipe 11 is formed by bending.

The width $l_1$ of trapezoidal guides 11*b* at the outer end corresponds to the width $l_2$ of trapezoidal guides 11*c* at the inner end. In addition, the width $L_1$ of trapezoidal guides 11*b* at the base is greater than the width $L_2$ of trapezoidal guide 11*c* at the outer end so that the opening of trapezoidal guides 11*c* can be enlarged by inserting into it trapezoidal guides 11*b*. Thus, flexible portions 11*d* are flexed inwardly toward and with respect to the sides of cut portion 11*a* when flat plates 11 are bent into the shape of header pipes. The bending of plates 11, and the assembly of tubes 4 into flat plates 11 is similar to the above discussion, as shown in FIG. 16(*c*).

Figure 17A:
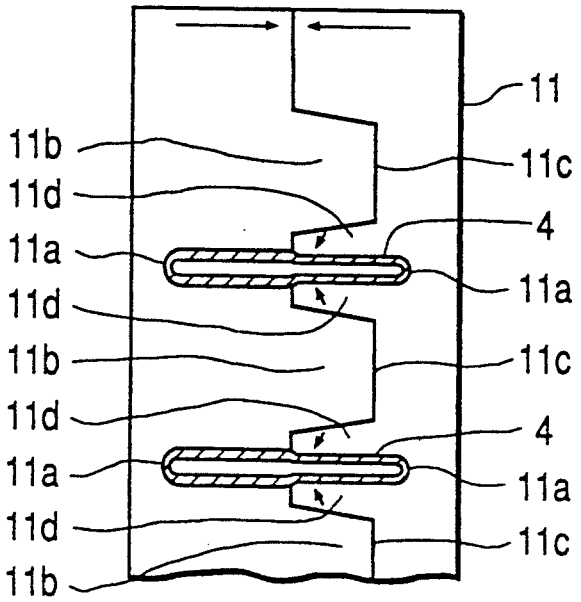
FIG. 17(*a*) is a cross-sectional view of a tube connected to a header pipe assembled as shown in FIGS. 16(*a*)-(*c*).
Figure 17B:
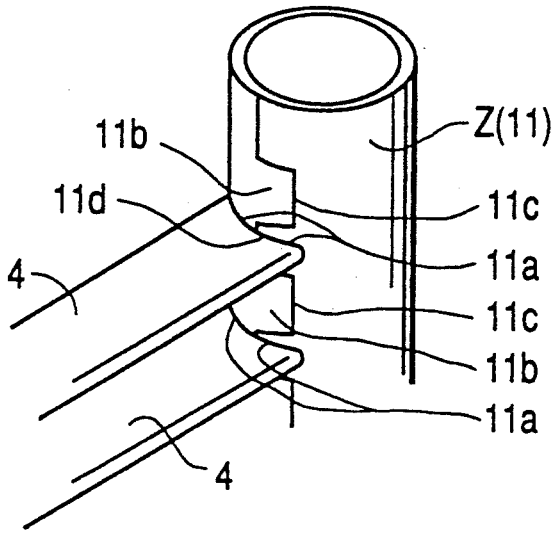

The cross-sectional shape of tubes 4 is deformed by the inward flexing of flexible portions 11*d* toward the sides of cut portions 11*a*, as shown in FIGS. 17(*a*) and (*b*) thereby firmly securing tubes 4 within the connection openings of header pipes 2.

Figure 18:
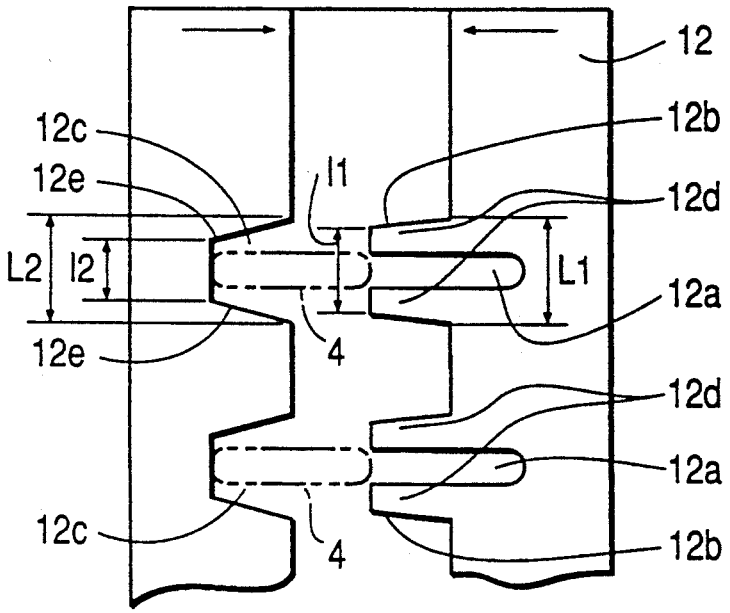
FIG. 18 is an explanatory view showing the assembly of a tube to a header pipe in accordance with a sixth embodiment of the present invention.

With reference to FIG. 18, the process of manufacturing a header pipe of a heat exchanger according to a sixth embodiment of the present invention is shown.

A plurality of inwardly projecting trapezoidal guides 12*c* are formed on one side of a longitudinal flat plate 12 and are defined with a predetermined pitch in the longitudinal direction. A plurality of outwardly projecting trapezoidal guides 12*b* are formed on the other side of longitudinal flat plate 12 so as to be opposite to trapezoidal guides 12*c* in the longitudinal direction, with the height of guides 12*b* from the longitudinal side of plate 12 corresponding to the depth of trapezoidal guides 12*c*. A plurality of cut portions 12*a* are formed in trapezoidal guides 12*b* at the longitudinal center, thereby forming a plurality of pairs of flexible portions 12*d* extending on either side of cut portion 12*a*. The shape of cut portions 12*a* corresponds to the cross-sectional shape of tubes 4. The width $L_2$ of trapezoidal guides 12*c* at the outer end corresponds to the width $L_1$ of trapezoidal guides 12*b* at the base. In addition, the width $l_1$ of trapezoidal guides 12*b* at the outer end is greater than the width $l_2$ of trapezoidal guides 12*c* at the base.

Simultaneously, when a pair of flexible portions 12*d* with tubes 4 disposed in cut portion 12*a* are inserted into trapezoidal guide 12*c*, since the outer width $l_1$ of the pair of flexible portions 12*d* is greater than the width $l_2$ of trapezoidal guide 12*c* at its base, and since each flexible portion 12*d* is flexible, the outer ends of both flexible portions 12*d* are flexed toward the outer surface of tube 4 by the side surfaces 12*e* of trapezoidal guides 12*c*, thereby firmly securing the connection between header pipe 2 and tubes 4.

Figure 19:
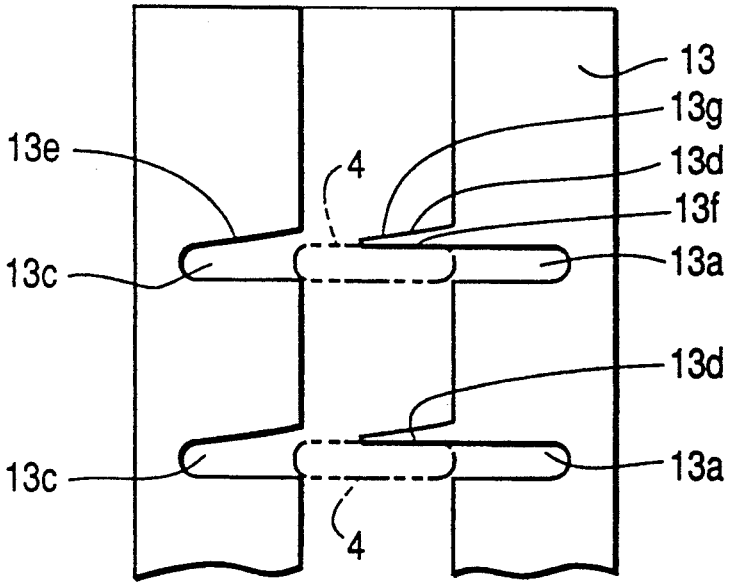
FIG. 19 is an explanatory view showing the assembly of a tube to a header pipe in accordance with an seventh embodiment of the present invention.

With reference to FIG. 19, the process of manufacturing a header pipe of a heat exchanger according to a seventh embodiment of the present invention is shown.

A plurality of inwardly projecting guides 13*c* are formed on one longitudinal side of flat plate 13 and are defined with a predetermined pitch in the longitudinal direction. A plurality of cut portions 13*a* are formed on the other longitudinal side of flat plate 13 and are positioned to be opposite to guides 13*c*. Tapered flexible portions 13*d* are formed to extend from the other longitudinal side of plate 13 and are adjacent to cut portions 13*a*. The depth of the guides 13*c* and cut portions 13*a* is one half of the width of tube 4. The length of flexible portions 13*d* corresponds to the depth of guides 13*c*. The width of guides 13*c* at the open end is greater than the thickness of tubes 4 so that both tubes 4 and flexible portions 13*d* can be inserted into the guides 13*c* during assembly of tubes 4 into finished header pipe 13. One side surface 13*f* of flexible portion 13*d* is on a line extending from and including the upper surface of cut portion 13*a*. The other side surface 13*g* of flexible portions 13*d* inclines inwardly toward surface 13*f* from the longitudinal side of plate 13. Side surface 13*e* of guide 13*c* is inclined outwardly from the inner end of guide 13*c* towards the longitudinal side of plate 13. Surface 13*g* of flexible portion 13*d* has a smaller slope than surface 13*e* of guide 13*c*. When assembled, flexible portions 13*d* are forcibly flexed downwardly toward the upper surface of tubes 4 by inclined side surfaces 13*e* of guides 13*c*, thereby firmly securing tubes 4 in the openings of header pipes 2.

I claim:

1. A method of manufacturing a heat exchanger including a pair of header pipes having a plurality of connection holes, and a plurality of tubes extending between the header pipes and having opposite open ends disposed through said connection holes, the method comprising the steps of:

forming a plurality of cut portions on opposite sides of a plurality of plates, each cut portion on one side corresponding to a cut portion on the other side;

bending said plates into nearly completed header pipes such that the opposite sides of said plates are near each other;

inserting said tubes between said nearly completed header pipes with each opposite open end of said tubes disposed in a pair of corresponding cut portions; and further bending said nearly completed header pipes into completed header pipes such that said cut portions form said connection holes.

2. The method recited in claim 1, said plate clad with a brazing material.

3. The method recited in claim 2, said cutting step including cutting cut portions to have outwardly extending guide surfaces extending towards the sides of said plate.

4. The method recited in claim 1, said cutting step including cutting cut portions to have outwardly extending guide surfaces extending towards the sides of said plate.

5. The method recited in claim 1, said header pipes having a tubular shape, said sides substantially in contact after said further bending.

6. The method recited in claim 1, said opposite sides comprising longitudinal sides.

7. A method of manufacturing a heat exchanger including a pair of header pipes having a plurality of connection holes, and a plurality of tubes extending between the header pipes and having opposite open ends disposed through said connection holes, the method comprising the steps of:

forming a plurality of cut portions on opposite sides of a plate, each cut portion on one side corresponding to a cut portion on the other side;

bending said plate into a nearly completed header pipe such that the opposite sides of said plate are near each other;

inserting said tubes between said nearly completed header pipe and a further header pipe with at least one opposite open end of each said tube disposed in a pair of corresponding cut portions; and further bending said nearly completed header pipe into a completed header pipe such that said cut portions form said connection holes.

8. A method of manufacturing a heat exchanger including a pair of header pipes having a plurality of connection holes, and a plurality of tubes extending between the header pipes and having opposite open ends disposed through said connection holes, the method comprising the steps of:

forming a plurality of cut portions on at least one side of a plurality of plates, a plurality of flexible portions extending adjacent to said cut portions from said side;

forming a plurality of guide portions on an opposite side of said plates, each said guide portion corresponding to one said flexible portion;

bending said plates into nearly completed header pipes such that the opposite sides of said plates are near each other;

inserting said tubes between said nearly completed header pipes with one opposite open end of each said tube disposed in one said cut portion; and further bending said nearly completed header pipes into completed header pipes such that said flexible portions are flexed into contact with said tubes by said guide portions.

9. The method recited in claim 8, said plate clad with a brazing material.

10. The method recited in claim 8, said opposite sides comprising longitudinal sides.

11. A method of manufacturing a heat exchanger including a pair of header pipes having a plurality of connection holes, and a plurality of tubes extending between the header pipes and having opposite open ends disposed through said connection holes, the method comprising the following steps:

forming a plurality of cut portions on at least one side of a plate, a plurality of flexible portions extending adjacent to said cut portions from said side;

forming a plurality of guide portions on an opposite side of said plate, each said guide portion corresponding to one said flexible portion;

bending said plate into a nearly completed header pipe such that the opposite sides of said plate are near each other;

inserting said tubes between said nearly completed header pipe and a further header pipe with one opposite open end of each said tube disposed in one said cut portion; and further bending said nearly completed header pipe into a completed header pipe such that said flexible portions are flexed into contact with said tubes by said guide portions.

12. The method recited in claim 4, said cut portions tapering inwardly from an inner end toward said guide surfaces.

13. The method recited in claim 1, said opposite sides overlapping after said further bending.

14. The method recited in claim 1, said header pipes having a semicircular shape, said sides substantially in contact after said further bending.

15. The method recited in claim 1, further comprising the step of further forming, after forming of said cut portions, of a plurality of extension portions on one side of said plate and a plurality of guide portions on the other side of said plate, said extension and guide portions being disposed between adjacent cut portions, said guide portions forming a plurality of flexible portions adjacent said cut portions, said flexible portions contacting said tube because of mating between said corresponding extension and guide portions after said further bending.

16. The method recited in claim 1, further comprising the step of further forming, after forming of said cut portions, of a plurality of extension portions on one side of said plate and a plurality of guide portions on the other side of said plate, said extension and guide portions having a trapezoidal shape and said extension portion being flexible and in contact with said tubes after said further bending.

17. The method recited in claim 7, said cutting step including cutting cut portions to have outwardly extending guide surfaces extending towards the sides of said plate.

18. The method recited in claim 17, said cut portions tapering inwardly from an inner end toward said guide surfaces.

19. The method recited in claim 7, said header pipes having a tubular shape said sides substantially in contact after said further bending.

20. The method recited in claim 7, said opposite sides overlapping after said further bending.

21. The method recited in claim 7, said header pipes having a semicircular shape, said sides substantially in contact after said further bending.

22. The method recited in claim 7, further comprising the step of further forming, after forming of said cut portions, of a plurality of extension portions on one side of said plate and a plurality of guide portions on the other side of said plate, said extension and guide portions being disposed between adjacent cut portions, said guide portions forming a plurality of flexible portions adjacent said cut portions, said flexible portions contacting said tube because of mating between said corresponding extension and guide portions after said bending.

23. The method recited in claim 22, said extension and guide portions having a trapezoidal shape.

24. The method recited in claim 7, further comprising the step of further forming, after forming of said cut portions, of a plurality of extension portions on one side of said plate and a plurality of guide portions on the other side of said plate, said extension portion being triangular in shape and in contact with said tubes after said further bending.

25. The method recited in claim 8, said guides being trapezoidal in shape.

26. The method recited in claim 8, said flexible portions being triangular in shape.

27. The method recited in claim 11, said guides being trapezoidal in shape.

28. The method recited in claim 11, said flexible portions being triangular in shape.

* * * * *